US009298147B2

(12) United States Patent
Hara

(10) Patent No.: US 9,298,147 B2
(45) Date of Patent: Mar. 29, 2016

(54) IMAGE FORMING APPARATUS WITH SEPARATING MECHANISM TO SEPARATE A ROLL SHEET FROM A FIXING MEMBER OR A PRESSURIZING MEMBER

(71) Applicant: Konica Minolta, Inc., Chiyoda-ku, Tokyo (JP)

(72) Inventor: Takahiro Hara, Tama (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/701,923

(22) Filed: May 1, 2015

(65) Prior Publication Data

US 2015/0316882 A1 Nov. 5, 2015

(30) Foreign Application Priority Data

May 2, 2014 (JP) ..... 2014-095069

(51) Int. Cl.
*G03G 15/20* (2006.01)
*G03G 15/00* (2006.01)

(52) U.S. Cl.
CPC ..... *G03G 15/2085* (2013.01)

(58) Field of Classification Search
CPC ..... G03G 15/2085; G03G 15/6576; G03G 2215/00662
USPC ..... 399/323, 406
See application file for complete search history.

(56) References Cited

U.S. PATENT DOCUMENTS

| | | | | |
|---|---|---|---|---|
| 4,771,310 | A * | 9/1988 | Leo et al. | 399/323 |
| 5,566,906 | A * | 10/1996 | Kamada et al. | 242/563 |
| 7,489,895 | B2 * | 2/2009 | Tani | 399/329 |
| 2004/0131406 | A1 * | 7/2004 | Ohki et al. | 399/384 |
| 2007/0206981 | A1 * | 9/2007 | Amico et al. | 399/323 |
| 2011/0091258 | A1 * | 4/2011 | Makinodan et al. | 399/406 |
| 2013/0321526 | A1 * | 12/2013 | Nakaoka et al. | 347/31 |

FOREIGN PATENT DOCUMENTS

| | | | |
|---|---|---|---|
| JP | 2002091237 | A | 3/2002 |
| JP | 2012063743 | A | 3/2012 |

* cited by examiner

*Primary Examiner* — Billy Lactaoen
(74) *Attorney, Agent, or Firm* — Cantor Colburn LLP

(57) ABSTRACT

In an image forming apparatus, a roll sheet carrying an unfixed toner image is passed through a nip portion of a fixing portion including a fixing member heated to a predetermined temperature and a pressurizing member press-contacted with the fixing member so as to fix the toner image on the roll sheet. Then, the control portion performs winding prevention control of the roll sheet around the fixing member and the pressurizing member in accordance with a winding direction of the roll sheet and/or a roll radius of the remaining roll sheet.

6 Claims, 3 Drawing Sheets

IMAGE FORMING APPARATUS WITH SEPARATING MECHANISM TO SEPARATE A ROLL SHEET FROM A FIXING MEMBER OR A PRESSURIZING MEMBER

CROSS REFERENCES TO RELATED APPLICATIONS

The present invention claims priority under 35 U.S.C. §119 to Japanese Application No. 2014-095069 filed May 2, 2014, the entire content of which is incorporated herein by reference.

BACKGROUND OF THE INVENTION

1. Field of the Invention

The present invention relates to an image forming apparatus applied to a copying machine, a printer, a facsimile machine and the like and particularly to an image forming apparatus that performs image formation on a roll sheet.

2. Description of the Related Art

An electrophotography type image forming apparatus becomes widespread which transfers a toner image formed on a photoreceptor to a transfer material such as a sheet and fixes the toner image onto the sheet by heating/pressurizing the sheet on which the toner image has been transferred in a fixing portion.

The fixing portion used in such an image forming apparatus includes a fixing member constituted by a heating roller, for example, and a pressurizing member provided at a position facing the fixing member and constituted by a facing roller rotating in pressure contact with the fixing member side. A toner image is fixed onto the sheet by passage of a sheet carrying an unfixed toner image through a nip portion between the fixing member and the pressurizing member.

Conventionally, in the image forming apparatus, various measures have been taken for preventing winding of the sheet around the fixing member or the pressurizing member side in the fixing portion. In "bishub PRESS C7000 (by Konica Minolta, Inc.)", for example, a configuration is adopted in which an actuator for detecting presence of a sheet is provided on a downstream side of the sheet in a conveying direction from the fixing portion in order to determine winding of the sheet around the fixing member. In the image forming apparatus, if the sheet is not detected by the actuator for a specified period of time, it is determined that the sheet has been wound around the fixing member.

Moreover, in Japanese Patent Laid-Open No. 2012-063743, in order to prevent jamming of the sheet wound around the fixing member by an adhesive force of the toner, a separation mechanism is provided which blows compressed air between the fixing member and the sheet so as to promote separation of the sheet from the fixing member.

On the other hand, in the electrophotography type image forming apparatus, a technology using a roll sheet as a transfer material is proposed (see Japanese Patent Laid-Open No. 2002-091237). In Japanese Patent Laid-Open No. 2002-091237, in order to solve a problem that curling tendency of the roll sheet becomes stronger as a remaining winding amount of the roll sheet reduces and thereby voids in transfer images tend to occur more easily, a configuration for controlling separation performance of the roll sheet from an image carrier in accordance with a remaining winding amount of the roll sheet is disclosed.

SUMMARY OF THE INVENTION

In the fixing portion, since the sheet is sandwiched by applying a nip load of 100 kg, for example, by the fixing member or the pressurizing member constituted by elastic members, it is likely that a middle part of the sheet which is long in the conveying direction such as roll sheet is wound around the fixing member or the pressurizing member. However, even if winding of the roll sheet around the fixing member or the pressurizing member occurs in the middle part of the roll sheet, conveyance of the roll sheet is not discontinued. Thus, in the configuration of the prior-art image forming apparatus in which the actuator for detecting presence of the sheet is provided on the downstream side of the fixing portion cannot detect winding of the roll sheet around the fixing member or the pressurizing member.

Moreover, the curl state of the roll sheet is largely changed depending on a winding direction in a set state or the remaining winding amount of the roll sheet. Thus, when the roll sheet is used, optimal separation performance cannot be ensured with the configuration having the separation mechanism for separating the sheet from the fixing member or the pressurizing member under the same condition at all times.

In view of the above-described points, an object of the present invention is to prevent winding of the roll sheet around the fixing member and the pressurizing member by separating the roll sheet from the fixing member and the pressurizing member of the fixing portion under the optimal condition in the image forming apparatus.

In order to solve the above-described problems and to achieve the object of the present invention, an image forming apparatus according to one aspect of the present invention includes a fixing portion and a control portion. The fixing portion passes a roll sheet carrying an unfixed toner image through a nip portion formed by a fixing member heated to a predetermined temperature and a pressurizing member press-contacted with the fixing member so as to fix the toner image on the roll sheet. The control portion performs winding prevention control of the roll sheet around the fixing member and the pressurizing member in accordance with a winding direction of the roll sheet and/or a roll radius of the remaining roll sheet.

In the image forming apparatus of the present invention, the control portion performs winding prevention control of the roll sheet in accordance with a winding direction of the roll sheet to the conveying direction of the roll sheet and/or a roll radius of the remaining roll sheet. As a result, winding around the fixing member and the pressurizing member can be prevented under the optimal condition at all times.

DESCRIPTION OF THE PREFERRED EMBODIMENTS

An example of an image forming apparatus according to an embodiment of the present invention will be described below by referring to the attached drawings. The present invention is not limited to the example below.

1. First embodiment: example in which winding prevention control is performed by controlling a separation mechanism 1-1. Configuration of image forming apparatus 1-2. Configuration of paper feeding device 1-3. Configuration of control system 1-4. Control method of image forming system 2. Second embodiment: example in which winding prevention control is performed by controlling a printing operation so that a printing ratio set in advance is not exceeded <1. First Embodiment: example in which winding prevention control is performed by controlling a separation mechanism>

Figure 1:
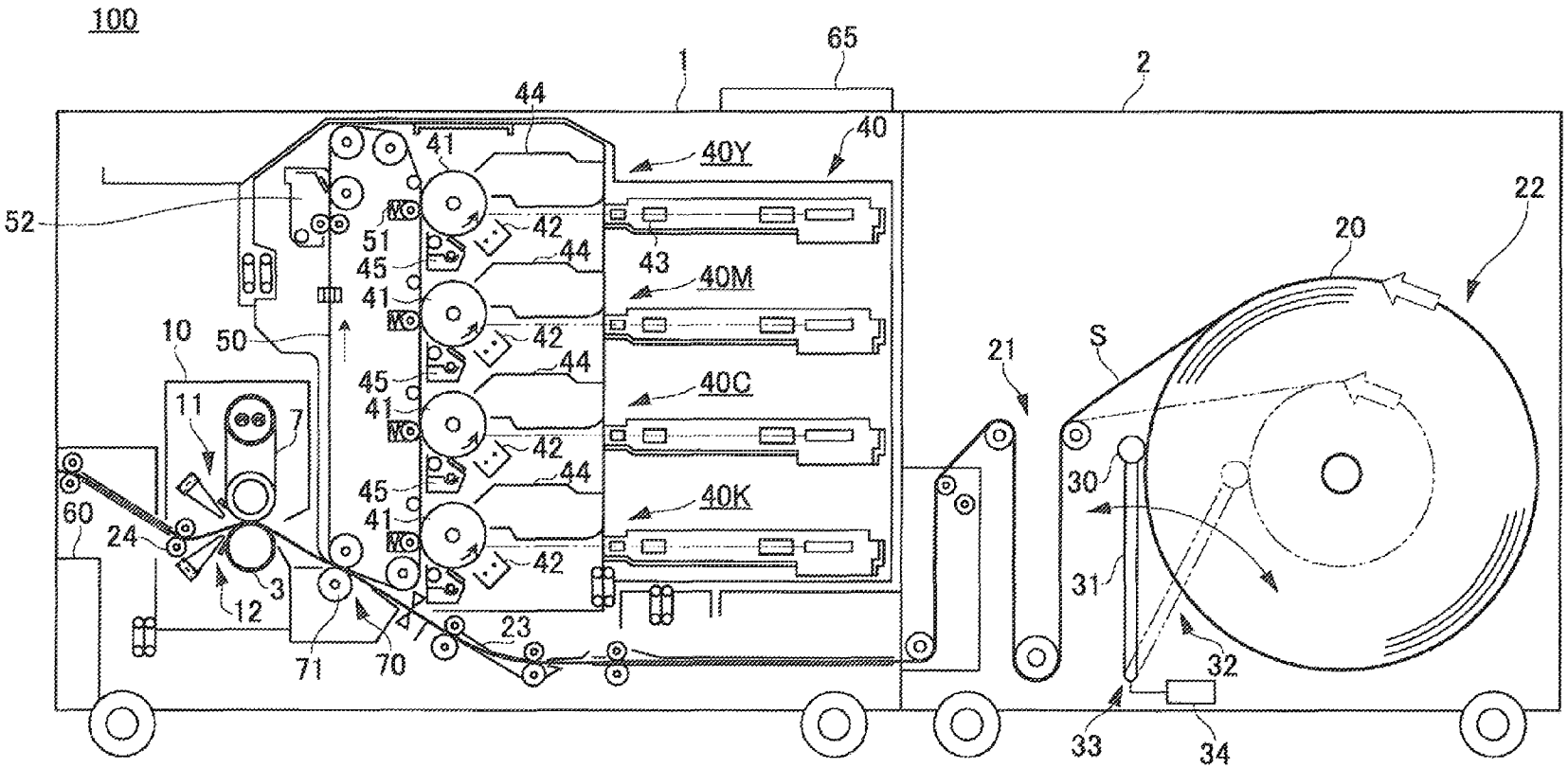
FIG. 1 is a schematic configuration diagram of an image forming system to which an image forming apparatus according to a first embodiment of the present invention is applied.
Figure 2:
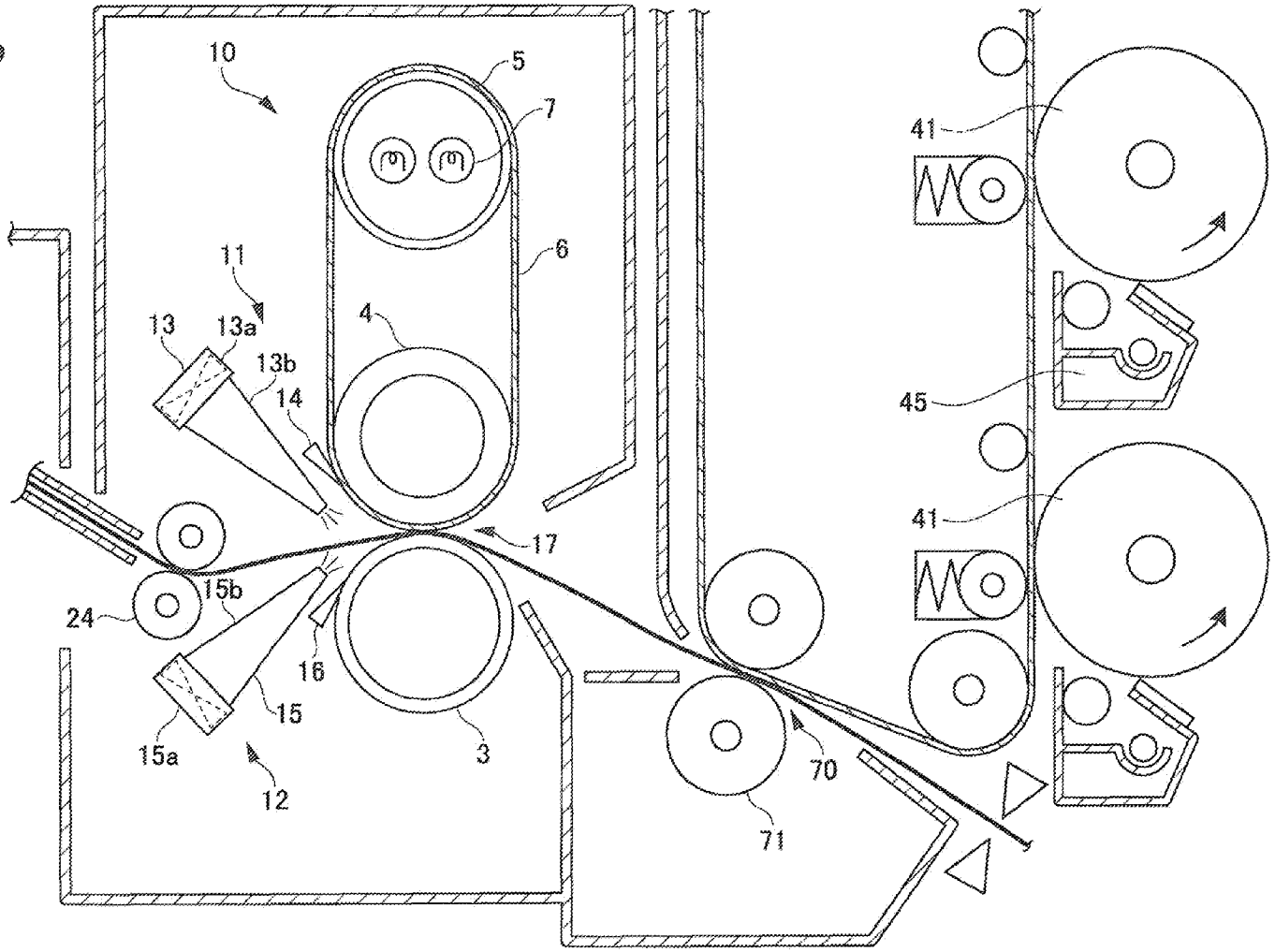
FIG. 2 is a schematic configuration diagram of an essential part of the image forming apparatus according to the first embodiment of the present invention.

FIG. 1 is a schematic configuration diagram of an image forming system 100 to which an image forming apparatus 1 according to the embodiment is applied. FIG. 2 is a schematic configuration diagram of an essential part of the image forming apparatus 1 according to the embodiment. The image forming system 100 includes the image forming apparatus 1 of the embodiment and a paper feeding device 2 for feeding roll sheet S to the image forming apparatus 1.

[1-1. Configuration of Image Forming Apparatus]

First, the image forming apparatus 1 will be described. The image forming apparatus 1 forms an image on a sheet by an electrophotography method and is a tandem-type color image forming apparatus for overlapping toners in four colors, that is, yellow (Y), magenta (M), cyan (C), and black (Bk).

As illustrated in FIG. 1, the image forming apparatus 1 of the embodiment includes a conveying portion 23, an image forming portion 40, an intermediate transfer belt 50, a secondary transfer portion 70, a fixing portion 10, and a control portion 60.

The conveying portion 23 is constituted by a plurality of conveying rollers provided on an upstream side of the secondary transfer portion 70 and continuously conveys the roll sheet S conveyed from the paper feeding device 2 to the secondary transfer portion 70 which is a transfer position.

The image forming portion 40 has four image forming units 40Y, 40M, 40C, and 40K for forming a toner image of yellow (Y), a toner image of magenta (M), a toner image of cyan (C), and a toner image of black (Bk).

The first image forming unit 40Y forms a toner image of yellow, the second image forming unit 40M forms a toner image of magenta. The third image forming unit 40C forms a toner image of cyan, and the fourth image forming unit 40K forms a toner image of black. Since these four image forming units 40Y, 40M, 40C, and 40K have the same configurations, respectively, the first image forming unit 40Y will be described as a representative example.

The first image forming unit 40Y has a drum-shaped photoreceptor 41, a charging portion 42 arranged in a periphery of the photoreceptor 41, an exposure portion 43, a development portion 44, and a cleaning device 45. The photoreceptor 41 is rotated by a driving motor (not shown) in a counterclockwise direction. The charging portion 42 imparts electric charges to the photoreceptor 41 to uniformly charge a surface of the photoreceptor 41. The exposure portion 43 performs exposure scanning on the surface of the photoreceptor 41 to form an electrostatic latent image on the photoreceptor 41, on the basis of image data transmitted from an outside.

The development portion 44 makes a toner of yellow adhere to the electrostatic latent image formed on the photoreceptor 41. As a result, the toner image of yellow is formed on the surface of the photoreceptor 41. The development portion 44 of the second image forming unit 40M makes a toner of magenta adhere to the photoreceptor 41, and the development portion 44 of the third image forming unit 40C makes a toner of cyan adhere to the photoreceptor 41. Then, the development portion 44 of the fourth image forming unit 40K makes a toner of black adhere to the photoreceptor 41.

The toner adhering onto the photoreceptor 41 is transferred to the intermediate transfer belt 50. The cleaning device 45 removes the toner remaining on the surface of the photoreceptor 41 after transfer to the intermediate transfer belt 50.

The intermediate transfer belt 50 is formed in an endless state and is rotated by a driving motor (not shown) in a clockwise direction opposite to the rotation direction of the photoreceptor 41. A primary transfer portion 51 is provided at positions facing the photoreceptor 41 of each of the image forming units 40Y, 40M, 40C, and 40K in the intermediate transfer belt 50. The primary transfer portion 51 transfers the toner image formed on the photoreceptor 41 onto the intermediate transfer belt 50 by applying polarity opposite to that of the toner to the intermediate transfer belt 50.

Then, by means of rotation of the intermediate transfer belt 50, the toner images formed by the four image forming units 40Y, 40M, 40C, and 40K are sequentially transferred onto the surface of the intermediate transfer belt 50. As a result, the toner image of yellow, the toner image of magenta, the toner image of cyan, and the toner image of black are overlapped with each other to form a color image on the intermediate transfer belt 50.

The secondary transfer portion 70 is arranged in the vicinity of the intermediate transfer belt 50 and on a downstream side of the conveying portion 23. The secondary transfer portion 70 is constituted by a pair of transfer rollers 71 composed of a transfer upper roller by which the intermediate transfer belt 50 is stretched and a transfer lower roller pressed onto a side of the transfer upper roller by sandwiching the intermediate transfer belt 50 between them.

In the secondary transfer portion 70, the roll sheet S conveyed from the conveying portion 23 is pressed onto the intermediate transfer belt 50 side by the transfer lower roller. Then, the secondary transfer portion 70 transfers the color toner image formed on the intermediate transfer belt 50 onto the sheet S sent from the conveying portion 23. The cleaning portion 52 removes the toner remaining on the surface of the intermediate transfer belt 50 after transfer onto the roll sheet S.

The fixing portion 10 includes a fixing belt 6 and a pressurizing roller 3 which is a pressurizing member. The fixing belt 6 is constituted by an endless elastic member and as illustrated in FIG. 2, it is supported and stretched between a fixing roller 4 which is a driving roller and a heating roller 5 which is a driven roller. The fixing belt 6 of the embodiment constitutes a fixing member of the present invention.

The fixing belt 6 is constituted by an elastic member in which a base surface layer constituted by PI (polyimide) is coated with PFA (tetrafluoroethylene), for example. The fixing roller 4 is constituted by a columnar member having an outer diameter of 50 to 90 mm and has an elastic layer having a thickness of 10 to 30 mm, for example, on a core metal. The heating roller 5 is constituted by a columnar member having an outer diameter of 50 to 90 mm and incorporating a halogen heater 7 therein, and the surface is coated with PTFE (polytetrafluoroethylene).

The heating roller 5 is heated by the halogen heater 7 to heat the fixing belt 6. At this time, the fixing belt 6 is controlled to 160 to 210° C. Then, the heated fixing belt 6 is rotated and made to run clockwise in the figure by rotation/driving of the fixing roller 4.

The pressurizing roller 3 is constituted by a columnar member having an outer diameter of 50 to 90 mm and has an elastic layer constituted by urethane rubber or the like having a thickness of 1 to 20 mm, for example, on a core metal and is provided so as to be press-contacted with the fixing roller 4 by sandwiching the fixing belt 6 by a pressurizing mechanism, not shown. The pressurizing roller 3 is rotated in conjunction with rotating/running fixing belt 6. In the embodiment, a linear velocity of the surface of the pressurizing roller 3 is 220 to 500 mm/s.

In the embodiment, the pressurizing roller 3 follows the fixing belt 6 as an example, but the pressurizing roller 3 may be constituted as a driving roller. Moreover, a heater for heating the pressurizing roller 3 may be provided.

Then, a nip portion 17 is formed at a portion where the fixing belt 6 and the pressurizing roller 3 are brought into contact with each other. By means of passage of the roll sheet S carrying the toner image through the nip portion 17, the toner is melted by the fixing belt 6 controlled to a predetermined temperature and the pressurizing roller 3 and is fixed onto the roll sheet S.

A first separation mechanism 11 is provided in the vicinity of the fixing belt 6 on a downstream side of the fixing portion 10 in a sheet conveying direction and includes a first separation claw 14 capable of contacting the fixing belt 6 and a first air injection portion 13 for injecting air to the fixing belt 6 side.

The first air injection portion 13 includes an axial flow fan 13*a* for sending out air at a desired air volume and a nozzle portion 13*b* for guiding the air sent out from the axial flow fan 13*a* so as to be injected between the roll sheet S coming out of the nip portion 17 and the fixing belt 6. An opening at a tip end of the nozzle portion 13*b* is constituted having an elongated shape along a direction orthogonal to a rotation direction of the fixing belt 6 and is provided so that its longitudinal direction becomes substantially in parallel with the nip portion 17. As a result, air can be injected uniformly to the roll sheet S having passed through the nip portion 17. The air volume of the air injected from the nozzle portion 13*b* can be adjusted by changing a rotation number of the axial flow fan 13*a* through control of a current value to be supplied to the axial flow fan 13*a*.

The first separation claw 14 is provided capable of being brought into contact with the fixing belt 6 at a position on a side opposite to the nip portion 17 with respect to an air injection position of the first air injection portion 13. The first separation claw 14 is constituted by a member having a triangular section so that its thickness gradually becomes smaller as it goes closer to a side (tip end side) to be in contact with the fixing belt 6 and is supported by a support member, not shown, capable of swing using a support shaft provided on a rear end on a side opposite to the tip end side as a rotating shaft. The first separation claw 14 is constituted by a moving mechanism, not shown, movably in a direction of getting close to the fixing belt 6 and in a direction of leaving therefrom, and when it moves to the fixing belt 6 side, the tip end of the first separation claw 14 is brought into contact with the surface of the fixing belt 6.

The first separation claw 14 may be constituted by a member extending in a width direction orthogonal to the conveying direction of the roll sheet S or may be constituted by a plurality of separation claws arranged in order separating from each other in the width direction of the roll sheet S. The first separation claw 14 is formed by using a material excellent in heat resistance and mold releasability and can be formed by using a material coated with PFA or PTFE. As a result, adhesion of the toner on the roll sheet S to the first separation claw 14 and fixation of the toner can be prevented.

In the embodiment, by injection of air from the first air injection portion 13, the roll sheet S can be peeled off from the fixing belt 6 easily, and the roll sheet S can be prevented from being wound around the fixing belt 6 side. Even if the roll sheet S is not peeled off from the fixing belt 6 by injection of air from the first air injection portion 13, the first separation claw 14 is brought into contact with the fixing belt 6 and enters between the fixing belt 6 and the roll sheet S, whereby the roll sheet S can be mechanically peeled off from the fixing belt 6.

A second separation mechanism 12 is provided in the vicinity of the pressurizing roller 3 on the downstream side of the fixing portion 10 in the sheet conveying direction and includes a second separation claw 16 capable of contacting the pressurizing roller 3 and a second air injection portion 15 for injecting air to the pressurizing roller 3 side.

The second air injection portion 15 includes an axial flow fan 15*a* for sending out air at a desired air volume and a nozzle portion 15*b* for guiding the air sent out from the axial flow fan 15*a* so as to be injected between the roll sheet S coming out of the nip portion 17 and the pressurizing roller 3. An opening at a tip end of the nozzle portion 15*b* is constituted having an elongated shape along a direction orthogonal to a rotation direction of the pressurizing roller 3 and is provided so that its longitudinal direction becomes substantially in parallel with the nip portion 17. As a result, air can be injected uniformly to the roll sheet S having passed through the nip portion 17. The air volume of the air injected from the nozzle portion 15*b* can be adjusted by changing a rotation number of the axial flow fan 5*a* through control of a current value to be supplied to the axial flow fan 15*a*.

The second separation claw 16 is provided capable of being brought into contact with the pressurizing roller 3 at a position on a side opposite to the nip portion 17 side with respect to an air injection position of the second air injection portion 15. The second separation claw 16 is constituted by a member having a triangular section so that its thickness gradually becomes smaller as it goes closer to a side (tip end side) to be in contact with the pressurizing roller 3 and is supported by a support member, not shown, capable of swing using a support shaft provided on a rear end on a side opposite to the tip end side as a rotating shaft. The second separation claw 16 is constituted by a moving mechanism, not shown, movably in a direction of getting close to the pressurizing roller 3 and in a direction of leaving therefrom, and when it moves to the pressurizing roller 3 side, the tip end of the second separation claw 16 is brought into contact with the surface of the pressurizing roller 3.

The second separation claw 16 may be constituted by a member extending in the width direction orthogonal to the conveying direction of the roll sheet S or may be constituted by a plurality of separation claws arranged in order separating from each other in the width direction of the roll sheet S. The second separation claw 16 is formed by using a material excellent in heat resistance and mold releasability and can be formed by using a material coated with PFA or PTFE, for example. As a result, adhesion of the toner on the roll sheet S to the second separation claw 16 and fixation of the toner can be prevented.

In the embodiment, by injection of air from the second air injection portion 15, the roll sheet S can be peeled off from the pressurizing roller 3 easily, and the roll sheet S can be prevented from being wound around the pressurizing roller 3 side. Even if the roll sheet S is not peeled off from the pressurizing roller 3 by injection of air from the second air injection portion 15, the second separation claw 16 is brought into contact with the pressurizing roller 3 and enters between the pressurizing roller 3 and the roll sheet S, whereby the roll sheet S can be mechanically peeled off from the pressurizing roller 3.

An operation display portion 65 is a touch panel made of a display such as a liquid crystal display (LCD), or an organic ELD (Electro Luminescence Display). The operation display portion 65 displays an instruction menu to users, information relating to acquired image data and the like. Moreover, the operation display portion 65 includes a plurality of keys and has a role of an input portion for receiving inputs of various instructions and data of characters, numerals and the like by a key operation of the user. In the embodiment, the user inputs a winding direction of a roll sheet body 20 set on a paper feeding device 2 which will be described later in the operation display portion 65.

The control portion 60 operates each part of the image forming apparatus 1 in accordance with an instruction from the operation display portion 65 or a personal computer 120 (see FIG. 3) connected outside. The embodiment is characterized in that the control portion 60 controls the first separation mechanism 11 and the second separation mechanism 12. The control portion 60 controls the first separation mechanism 11 and the second separation mechanism 12 on the basis of information relating to a remaining winding amount of the roll sheet S sent from the paper feeding device 2 which will be described later and information relating to the winding direction of the roll sheet body 20 inputted from the operation display portion 65. The control method will be described later in more detail.

[1-2. Configuration of Paper Feeding Device]

Subsequently, the paper feeding device 2 will be described. The paper feeding device 2 includes a roll sheet placing portion 22, a conveying portion 21, and a remaining winding amount measuring portion 32.

On the roll sheet placing portion 22, a desired roll sheet body 20 is placed. In the explanation below, the roll sheet in a state placed on the roll sheet placing portion 22 is referred to as the "roll sheet body 20", and the roll sheet conveyed from the roll sheet placing portion 22 is referred to as a "roll sheet S". The conveying portion 21 is constituted by a plurality of conveying rollers and conveys the roll sheet S ejected from the roll sheet placing portion 22 to the image forming apparatus 1 side.

The remaining winding amount measuring portion 32 measures a remaining winding amount of the set roll sheet body 20. The remaining winding amount measuring portion 32 can be constituted by a roller actuator 33 including a roller 30 rolling on a surface of the set roll sheet body 20 and an arm 31 connected to the roller 30, and a remaining winding amount calculating portion 34. In the roller actuator 33, as the remaining winding amount of the roll sheet body 20 is reduced, the roller 30 gets closer to a core portion of the roll sheet body 20 and thus, the arm 31 is inclined from an initial position. In the embodiment, the inclination (angle) of the arm 31 is measured by the roller actuator 33, and the remaining winding amount calculating portion 34 calculates a remaining winding amount (roll radius) of the roll sheet body 20 from the measured value.

[1-3. Configuration of Control System]

Figure 3:
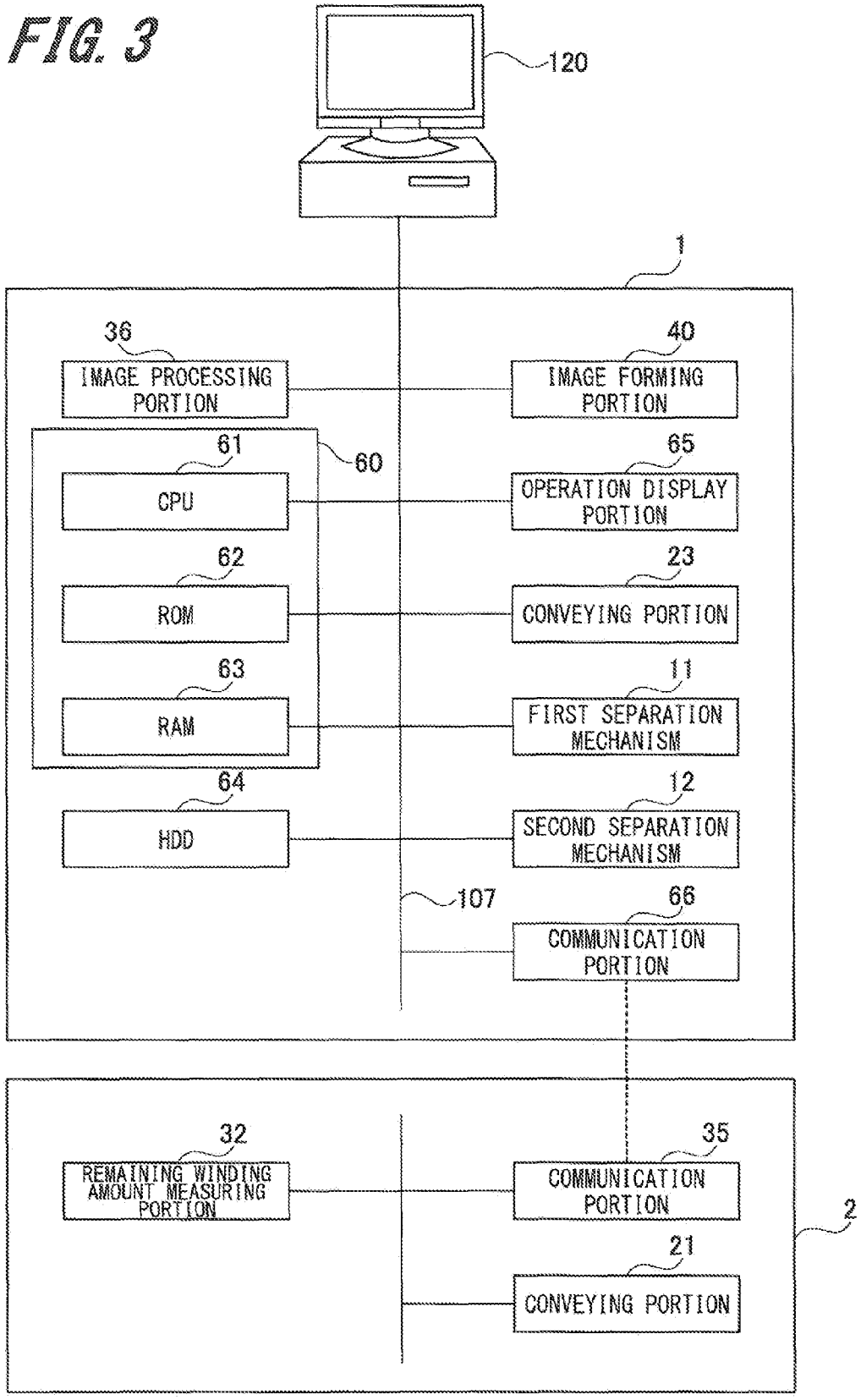
FIG. 3 is a block diagram illustrating a control system of the image forming system.

FIG. 3 is a block diagram illustrating an internal configuration of the image forming system 100. As illustrated in FIG. 3, the image forming apparatus 1 includes the control portion 60, an image processing portion 36, the image forming portion 40, the operation display portion 65, the conveying portion 23, an HDD 64, the first separation mechanism 11, the second separation mechanism 12, and a communication portion 66. Moreover, the paper feeding device 2 includes the conveying portion 21, the remaining winding amount measuring portion 32, and a communication portion 35.

The control portion 60 has, for example, a CPU (Central Processing Unit) 61, a ROM (Read Only Memory) 62 for storing a program executed by the CPU 61 and the like, and a RAM (Random Access Memory) 63 used as a work area of the CPU 61. As the ROM 62, a programable ROM which is electrically erasable is usually used.

The control portion 60 is connected to each of the image processing portion 36, the image forming portion 40, the opreation display portion 65, the conveying portion 23, the HDD 64, the first separation mechanism 11, the second separation mechanism 12, and the communication portion 66 via a system bus 107 and controls the entire apparatus. Moreover, the control portion 60 controls each part of the paper feeding device 2 through the communication portions 66 and 35.

Image data transmitted from a PC (personal computer) 120 illustrating an example of an external device connected to the image forming apparatus 1 is sent to the image processing portion 36 and image-processed in the image processing portion 36. The image processing portion 36 performs image processing such as shading correction, image density adjustment, image compression and the like on the received image data as necessary under control of the control portion 60. Moreover, the image forming portion 40 receives the image data image-processed by the image processing portion 36 under control of the control portion 60 and forms an image on the roll sheet S on the basis of the image data.

The user inputs a winding direction of the roll sheet body 20 set on the paper feeding device 2, a type of the roll sheet S (paper type) and the like in the operation display portion 65.

The communication portions 66 and 35 are communication interfaces for connection to a network to which each device constituting the image forming apparatus 100 is connected. For example, the image forming apparatus 1 and the paper feeding device 2 conduct serial communication via the respective commutation portions 66 and 35.

The control portion 60 controls the first separation mechanism 11 and the second separation mechanism 12 in accordance with the information of the winding direction of the roll sheet body 20 inputted in the operation display portion 65 and the information relating to the remaining winding amount of the roll sheet body 20 sent from the paper feeding device 2 via the communication portions 66 and 35.

Whether or not the roll sheet S is wound around the fixing portion 10 is largely affected by a direction or size of a curl of the roll sheet S. For example, the roll sheet S curled in a downward projecting state can be easily wound around the fixing belt 6 (upper roller) side, while the roll sheet S curled in an upward projecting state can be easily wound around the pressurizing roller 3 (lower roller) side. Such a direction of the curl of the roll sheet S before print depends on the winding direction of the roll sheet body 20 set on the paper feeding device 2. Here, the winding direction of the roll sheet body 20 is assumed to refer to a rotation direction of the roll sheet body S when the roll sheet S is conveyed. Moreover, a size of curvature of the curl changes in accordance with the remaining winding amount of the set roll sheet S, and the smaller the remaining winding amount is, that is, the closer the roll sheet S is to the core part, the larger the curvature of the curl becomes.

In the embodiment, the control portion 60 can control the first separation mechanism 11 or the second separation mechanism 12 in accordance with the winding direction and the remaining winding amount of the roll sheet body 20 and thus, the optimal separation performance according to a state of the roll sheet S ejected from the fixing portion 10 can be ensured. A specific control method of the first separation mechanism 11 and the second separation mechanism 12 will be illustrated below.

[1-4. Control Method of Image Forming System]

Subsequently, an example of a control method of the image forming system 100 of the embodiment will be described. In the embodiment, an example in which, as illustrated in FIG. 1, the paper feeding device 2 is arranged on the right side of the image forming apparatus 1, and the roll sheet body 20 is set with a counterclockwise direction on the paper feeding device 2 will be described. Here, the "counterclockwise direction" means that the roll sheet body 20 rotates counterclockwise when the roll sheet S is fed from the paper feeding device 2. That is, in the embodiment, as the roll sheet body 20 rotates counterclockwise in the paper feeding device 2, the roll sheet S is conveyed from the right to the left and conveyed into the image forming apparatus 1. Moreover, in the embodiment, an example in which the roll sheet body 20 having a roll radius (initial radius) before use of 600 mm and a minimum value of 300 mm is used will be described.

First, prior to start of print (start of image formation), the user inputs the winding direction of the roll sheet body 20 set on the paper feeding device 2 from the operation display portion 65. A plurality of control tables of the first separation mechanism 11 and the second separation mechanism 12 is stored in the ROM 62 of the control portion 60, and the control portion 60 selects a control table in accordance with the winding direction of the roll sheet body 20 and conditions such as a paper type inputted by the user from the operation display portion 65. In the embodiment, the control table illustrated in Table 1 below is selected.

sent to the image forming apparatus 1 via the communication portions 35 and 66 during operation of the image forming system 100.

In the image forming apparatus 1, the control portion 60 refers to the above-described control table in Table 1 on the basis of the calculated value of the remaining winding amount sent from the paper feeding device 2 and controls the first separation mechanism 11 and the second separation mechanism 12. In the embodiment, the remaining winding amount measuring portion 32 is constituted by the roller actuator 33 and the remaining winding amount calculating portion 34 in the example, but any other configurations may be used as long as the roll radius of the roll sheet body 20 can be measured.

As illustrated in Table 1, adjustment of the air volumes injected from the first and second air injection portions 13 and 15 is made in three stages, that is, "strong", "weak", and "OFF" in which the air is not injected, for example. Adjustment of the first separation claw 14 is made between a state in which the claw is moved to a position in contact with the fixing belt 6 (indicated by "in contact") and a state in which it is moved to a position separating from the fixing belt 6 (indicated by "separating"). Adjustment of the second separation claw 16 is made between a state in which the claw is moved to a position in contact with the pressurizing roller 3 (indicated by "contact") and a state in which it is moved to a position separating from the pressurizing roller 3 (indicated by "separating").

TABLE 1

CONTROL TABLE

| FIXING PORTION | CONTROL ITEM | | ROLL SHEET WINDING DIRECTION | ROLL RADIUS (REMAINING WINDING AMOUNT) (mm) 600~500 | 500~400 | 400~300 |
|---|---|---|---|---|---|---|
| FIXING BELT | FIRST SEPARATION MECHANISM | AIR VOLUME OF FIRST AIR INJECTION PORTION | COUNTERCLOCKWISE | WEAK | OFF | OFF |
| | | | CLOCKWISE | WEAK | STRONG | STRONG |
| | | FIRST SEPARATION CLAW | COUNTERCLOCKWISE | IN CONTACT | SEPARATING | SEPARATING |
| | | | CLOCKWISE | IN CONTACT | IN CONTACT | IN CONTACT |
| PRESSURIZING ROLLER | SECOND SEPARATION MECHANISM | AIR VOLUME OF SECOND AIR INJECTION PORTION | COUNTERCLOCKWISE | WEAK | STRONG | STRONG |
| | | | CLOCKWISE | WEAK | OFF | OFF |
| | | SECOND SEPARATION CLAW | COUNTERCLOCKWISE | IN CONTACT | IN CONTACT | IN CONTACT |
| | | | CLOCKWISE | IN CONTACT | SEPARATING | SEPARATING |

When the print is started, as the roll sheet body 20 is rotated counterclockwise, the roll sheet S is fed out from the right to the left and is conveyed into the image forming apparatus 1. In the image forming apparatus 1, by means of passage of the roll sheet S through the secondary transfer portion 70, the toner image carried by the intermediate transfer belt 50 is transferred to the surface of the roll sheet S. Then, when the roll sheet S carrying the unfixed toner image is fed into the fixing portion 10, by means of rotation of the fixing belt 6 and the pressurizing roller 3, the roll sheet S is sandwiched by the nip portion 17 and conveyed. Then, by means of passage through the nip portion 17, the toner image is fixed on the roll sheet S.

On the other hand, in the paper feeding device 2, when print is started, the remaining winding amount measuring portion 32 calculates a roll radius (remaining winding amount) from the measured value of the angle of the arm 31 of the roller actuator 33 in contact with an outer peripheral surface of the roll sheet body 20. The roll radius is calculated at all times and In the embodiment, the roll sheet body 20 is set counterclockwise. In this case, if the roll radius is 600 to 500 mm, a curl amount is not so large, but it is likely that the roll sheet is wound around both the fixing belt 6 side and the pressurizing roller 3 side. In this case, the air volumes of the first air injection portion 13 and the second air injection portion 15 are set to "weak", and the first separation claw 14 and the second separation claw 16 are set to "in contact". On the other hand, if the roll radius is as small as 400 to 300 mm, curvature of the upward projecting curl becomes large, and it is highly likely that the roll sheet is wound around the pressurizing roller 3 side. In this case, the air volume of the first air injection portion 13 is set to "OFF", the first separation claw 14 to "separating", the air volume of the second air injection portion 15 to "strong", and the second separation claw 16 to "in contact".

As described above, by controlling the first separation mechanism 11 and the second separation mechanism 12 in accordance with the winding direction of the roll sheet body 20 and the roll radius, the optimal separation performance can be obtained. In the above, the case in which the roll sheet body 20 is set counterclockwise is described, but if the roll sheet S is set clockwise, the first separation mechanism 11 and the second separation mechanism 12 are controlled by using the information described in a column of the "clockwise" in Table 1.

Here, considering only the separation performance, it is preferable that the air volumes of the first and second air injection portions 13 and 15 are set to "strong", and the first and second separation claws 14 and 16 to "in contact" at all times. However, the stronger the air volumes injected from the first and second air injection portions 13 and 15 are set, the more heat escapes from the fixing belt 6 and fixation properties lower, and the heat is diffused in the apparatus and might cause nonconformities such as condensation of the toner before transfer or defective operation of the various sensors and the like. If a period of time during which the first and second separation claws 14 and 16 are in contact with the fixing belt 6 and the pressurizing roller 3, respectively, is prolonged, the surfaces of the fixing belt 6 and the pressurizing roller 3 are damaged, and vertical streaks occur in a transferred image. Therefore, if the separation capacity is excessively enhanced, the above-described bad effects increase.

On the other hand, in the embodiment, since the optimal separation control can be performed in accordance with the winding direction or the curl amount (size of curvature of a curl) of the roll sheet S, the bad effects caused by diffusion of the heat from the fixing belt 6 or occurrence of a damage on the fixing portion 10 can be prevented.

If a distance between the set position of the roll sheet body 20 and the fixing portion 10 of the image forming apparatus 1 is large, a difference between the roll radius measured at certain timing and the roll radius measured when the roll sheet S having reached the fixing portion 10 at the timing was in the set position becomes large. Moreover, winding tendency becomes stronger as it gets closer to the terminal end portion of the roll sheet S. Therefore, when it gets closer to the terminal end of the roll sheet S and the roll radius becomes small, a difference between the roll radius measured at certain timing and the roll radius measured when the roll sheet Shaving reached the fixing portion 10 at the timing was in the set position also becomes large.

Thus, it is preferable that the measured value obtained by the remaining winding amount measuring portion 32 is reflected in control of the first separation mechanism 11 and the second separation mechanism 12 at the timing when the roll sheet S of the measured portion passes through the fixing portion 10. In this case, the user sets a distance from the roll sheet placing portion 22 of the paper feeding device 2 to the fixing portion 10 of the image forming apparatus 1 by the operation display portion 65 in advance, and the measured value measured by the remaining winding amount measuring portion 32 at a point of time going back the conveying time for the distance is reflected in winding prevention control of the roll sheet S, for example. For example, in a case in which the conveying distance from the roll sheet placing portion 22 of the paper feeding device 2 to the fixing portion 10 is 3000 [mm] and a conveying speed of the roll sheet S is 300 [mm/s], the first and second separation mechanisms 11 and 12 are controlled by considering that a measured value of the remaining winding amount measuring portion 32 at the point of time going back only by 3000 [mm]/300 [mm/s]=10 [s] to be the roll radius of the roll sheet S currently being in the fixing portion 10.

As described above, since the roll radius measured at the timing when the roll sheet S being in the vicinity of the fixing portion 10 in the winding prevention control is in the roll sheet placing portion 22 can be reflected in the winding prevention control, more optimal separation performances can be exerted.

As described above, according to the image forming apparatus 1 of the embodiment, by controlling the first separation mechanism 11 and the second separation mechanism 12 in accordance with the winding direction and the roll radius of the roll sheet body 20, winding of the middle part of the roll sheet S around the fixing belt 6 and the pressurizing roller 3 can be prevented.

A conveying roller 24 is arranged on the downstream side of the fixing portion 10 in the sheet conveying direction, and the roll sheet S is pulled by the conveying roller at all times so as to prevent winding of the roll sheet S around the fixing belt 6 or the pressurizing roller 3. However, if the roll sheet S is nipped with a large load immediately after passage through the fixing portion 10, toner separation or uneven brightness occurs and thus, it is difficult to increase a conveying force of the conveying roller 24 arranged on the downstream side of the fixing portion 10 in the sheet conveying direction. Therefore, even if the conveying roller 24 is arranged, there is a concern that the roll sheet S is wound around the fixing belt 6 or the pressurizing roller 3 depending on the size of the curl or paper type of the roll sheet S.

In the embodiment, since winding of the roll sheet S around the fixing belt 6 and the pressurizing roller 3 is prevented by the first separation mechanism 11 and the second separation mechanism 12, the conveying force of the conveying roller 24 does not have to be increased, and there is no concern of toner separation or uneven brightness.

In the embodiment, the separation performance by air is adjusted by the air volumes injected from the first air injection portion 13 and the second air injection portion 15, but adjustment may be made by a direction of the air. For example, the separation performance can be adjusted by setting the directions of the air injected from the first air injection portion 13 and the second air injection portion 15 in parallel with a tangent of the fixing belt 6 or the pressurizing roller 3 or perpendicular to that.

Moreover, the control table illustrated in Table 1 of the embodiment is for the case in which the paper feeding device 2 is arranged on the right side of the image forming apparatus 1, and the roll sheet S is conveyed from the right to the left. Therefore, in a case in which the paper feeding device 2 is arranged on the left side of the image forming apparatus 1 or in a case in which the roll sheet S is conveyed in a vertical direction inside the image forming apparatus 1 and the toner image is transferred to a lower side of the roll sheet S or the like, the optimal control is different from that in Table 1. Moreover, the optimal control is also different depending on the type of the roll sheet S (paper type, basis weight and the like). Therefore, in the image forming apparatus 1 of the embodiment, control tables for various conditions are stored in advance, and the control portion 60 selects the control table to be used in accordance with a value inputted by the user from the operation display portion 65.

Moreover, in the embodiment, the first separation mechanism 11 and the second separation mechanism 12 are configured to be controlled in accordance with the information of the winding direction of the roll sheet S and the information of the roll radius, but the first separation mechanism 11 and the second separation mechanism 12 may be controlled in accordance with either one of the information of the winding direction of the roll sheet S and the information of the roll radius.

<2. Second embodiment: example in which winding prevention control is performed by controlling a printing operation so that a printing ratio set in advance is not exceeded>

Subsequently, an image forming system according to a second embodiment will be described. The image forming system of the embodiment is different only in a control method from the first embodiment, and the configuration is similar to that in FIG. 1 and thus, the explanation will be made by using FIG. 1. The embodiment is an example considering winding of the roll sheet S around the fixing belt 6 side by an adhesive force of the toner melted by heat.

The toner on the roll sheet S melted by the heat plays a role of a glue and thus, if an image printing ratio is high, the adhesive force becomes high and the separation performance from the fixing belt 6 lowers. Therefore, by combining the winding direction of the roll sheet body 20 and the high image printing ratio, the separation performance of the roll sheet from the fixing belt 6 extremely deteriorates.

In order to prevent this, in the embodiment, in the case of the winding direction (clockwise with a downward projecting curl in the embodiment) of the roll sheet body 20 which is easily wound around the fixing belt 6 on an image surface side, an upper limit of the printing ratio of an image to be formed on the roll sheet S is regulated as illustrated in Table 2 below:

TABLE 2

CONTROL TABLE

| FIXING PORTION | CONTROL ITEM | ROLL SHEET WINDING DIRECTION | ROLL RADIUS (REMAINING WINDING AMOUNT) (mm) 600~500 | 500~400 | 400~300 |
|---|---|---|---|---|---|
| FIXING BELT | PRINTING RATIO UPPER LIMIT (NORMAL RATIO) | CLOCKWISE | 100% | 90% | 80% |

For example, if the roll radius is in a range of 600 to 500 mm, curvature of the curl of the roll sheet S is not so large, and the roll sheet S is less likely to be wound around the fixing belt 6 and thus, the upper limit of the printing ratio is set to 100%. On the other hand, if the roll radius is in a range of 400 to 300 mm, the curvature of the curl of the roll sheet S is large, and it is highly likely that the roll sheet is wound around the fixing belt 6 and thus, the upper limit of the printing ratio is set to 80%. Then, if an image with the printing ratio higher than the upper limit of the printing ratio specified in Table 2 is to be outputted, occurrence of jamming is concerned about. Thus, the control portion 60 either stops print or displays an alarm on the operation display portion 65 that density of the image to be printed should be lowered. That is, in the embodiment, the control portion 60 controls a print operation in accordance with the roll radius so that the printing ratio determined in advance is not exceeded. The control of the print operation here includes control of the printing ratio and the like in addition to control of continuation/stop of print and control of the print density.

In the embodiment, the example in which an image is formed on the surface of the roll sheet S is described, but if an image is formed on a back surface of the roll sheet S, the similar effect can be obtained by replacing the column of "winding direction of roll sheet" in Table 2 by "counterclockwise".

As described above, in the embodiment, the control portion 60 performs the winding prevention control by controlling each part of the image forming apparatus 1 in accordance with the roll radius so that the printing ratio determined in advance is not exceeded. Moreover, it may be so configured that the first separation mechanism 11 and the second separation mechanism 12 described in the first embodiment are controlled in accordance with the printing ratio determined in advance corresponding to the roll radius.

For example, if the roll radius is 550 mm, control is usually assumed to be performed in accordance with the column of the roll radius of [600 to 500 mm] in Table 1, but if the printing ratio is higher than 90%, control is performed in accordance with the column of the roll radius of [500 to 400 mm] in Table 1. As described above, if the printing ratio is higher than a predetermined specified value, it may be so configured that the separation performance applied to the first separation mechanism 11 and the second separation mechanism 12 is improved by one step.

Moreover, the winding prevention control may be performed by executing the first embodiment and the second embodiment at the same time, and various changes are possible within a range not departing from the gist of the present invention.

In the first and second embodiments, the belt fixation method using the fixing belt as a fixing member is used, but a roller fixation method using a fixing roller as the fixing member may be used. Moreover, the heating means of the fixing member is not limited to a heater such as a halogen lamp but an induction heating method can be also adopted.

Moreover, in the first and second embodiments, the color image forming apparatus is described as an example, but the present invention can be applied also to a monochrome image forming apparatus. Moreover, the image forming apparatus is not limited to a copier but a printer or a facsimile machine or a complex machine provided with a plurality of functions may be used.

What is claimed is:

1. An image forming apparatus performing image formation using a roll sheet wound by a predetermined number of winding times, comprising:

a fixing portion configured to pass a roll sheet carrying an unfixed toner image through a nip portion formed by a fixing member heated to a predetermined temperature and a pressurizing member press-contacted with the fixing member so as to fix the toner image on the roll sheet; and a control portion configured to perform winding prevention control of the roll sheet around the fixing member and the pressurizing member in accordance with a winding direction of the roll sheet and/or a roll radius of the remaining roll sheet;

wherein the control portion performs the winding prevention control by controlling a separation mechanism configured to separate the roll sheet from the fixing member or the pressurizing member;

the separation mechanism comprises:

a first separation mechanism configured to separate the roll sheet having passed through the nip portion from the fixing member; and a second separation mechanism configured to separate the roll sheet having passed through the nip portion from the pressurizing member;

the first separation mechanism has a first separation claw that separates the roll sheet having passed through the nip portion from the fixing member and a first air injection portion that injects air between the roll sheet having passed through the nip portion and the fixing member; and the second separation mechanism has a second separation claw that separates the roll sheet having passed through the nip portion from the pressurizing member and a second air injection portion that injects air between the roll sheet having passed through the nip portion and the fixing member.

2. The image forming apparatus according to claim 1, wherein the first separation claw is controlled by the control portion so as to move in a direction brought into contact with the fixing member or in a direction separating from the fixing member; and the second separation claw is controlled by the control portion so as to move in a direction brought into contact with the pressurizing member or in a direction separating from the fixing member.

3. The image forming apparatus according to claim 1, wherein an air volume of the air injected from the first air injection portion is controlled by the control portion; and an air volume of the air injected from the second air injection portion is controlled by the control portion.

4. The image forming apparatus according to claim 1, wherein the control portion performs the winding prevention control by controlling a print operation in accordance with a printing ratio set in advance on the basis of a winding direction of the roll sheet and/or a roll radius of the remaining roll sheet.

5. The image forming apparatus according to claim 1, wherein the winding prevention control is performed in accordance with a printing ratio of an image.

6. The image forming apparatus according to claim 1, wherein the roll radius is measured at a set position of the roll sheet; and the control portion uses the roll radius as measured at a time when the roll sheet in the vicinity of the fixing portion in the winding prevention control was in the set position in the winding prevention control.

* * * * *